US008307527B2

(12) United States Patent
Huang

(10) Patent No.: US 8,307,527 B2
(45) Date of Patent: Nov. 13, 2012

(54) DEVICE FOR HOLDING TIMING GEARS

(75) Inventor: Chia-Hao Huang, Taiping (TW)

(73) Assignee: Poul Chang Metal Industry Co., Ltd., Taichung Hsien (TW)

( * ) Notice: Subject to any disclaimer, the term of this patent is extended or adjusted under 35 U.S.C. 154(b) by 379 days.

(21) Appl. No.: 12/707,655

(22) Filed: Feb. 17, 2010

(65) Prior Publication Data

US 2011/0197411 A1 Aug. 18, 2011

(51) Int. Cl.
*B25B 27/14* (2006.01)

(52) U.S. Cl. ..... 29/281.5

(58) Field of Classification Search ..... 29/271, 29/281.5, 281.1, 245, 256, 258, 259, 261, 29/266; 269/37, 43, 45, 104; 254/134
See application file for complete search history.

(56) References Cited

U.S. PATENT DOCUMENTS 546,421 A * 9/1895 Duke ..... 269/9
4,239,196 A * 12/1980 Hanger ..... 269/17
5,490,582 A * 2/1996 Trowbridge ..... 188/2 R
5,755,029 A * 5/1998 Learned ..... 29/888.011
5,950,294 A * 9/1999 Gibbs ..... 29/281.5
6,058,585 A * 5/2000 Soleymani ..... 29/281.6
6,332,256 B1 * 12/2001 Dawson ..... 29/281.5
6,694,587 B2 * 2/2004 Whitehead ..... 29/281.5
6,698,075 B1 * 3/2004 Wu ..... 29/281.5
6,912,768 B2 * 7/2005 Whitehead ..... 29/559
7,047,610 B2 * 5/2006 Dawson ..... 29/281.1
7,055,230 B2 * 6/2006 Wu ..... 29/281.5
7,225,517 B2 * 6/2007 Mitchell ..... 29/281.5
7,752,727 B2 * 7/2010 Mitchell ..... 29/281.5

* cited by examiner

*Primary Examiner* — Lee D Wilson
*Assistant Examiner* — Jamal Daniel

(57) ABSTRACT

Disclosed is a device for holding a relative angle between two timing gears. The device includes a connector, two stationary engagement elements, two levers, two movable engagement elements and two fastening units. Each of the stationary engagement elements extends from the connector and can be located between two adjacent teeth of a related one of the timing gears. The levers are pivotally connected to the connector. Each of the movable engagement elements is movably connected to a related one of the levers and can be located between two other adjacent teeth of a related one of the timing gears. Each of the fastening units is operable to retain a related one of the movable engagement units in position relative to a related one of the levers.

9 Claims, 4 Drawing Sheets

DEVICE FOR HOLDING TIMING GEARS

BACKGROUND OF INVENTION

1. Field of Invention

The present invention relates to a vehicle and, more particularly, to a timing belt wound around timing gears of a vehicle and, more particularly, to a device for holding timing gears of a vehicle when a timing belt is disengaged from them.

2. Related Prior Art

A vehicle includes a timing belt wound around timing gears to drive cam shafts and a crank shaft to open and close valves of cylinders in a predetermined order. The timing belt is made of rubber that suffers fractures due to aging, excessive stress, erosion for example. The timing belt must be checked and replaced with a new one regularly to ensure normal operation of the vehicle.

To replace an old timing belt with a new timing belt, the relative angle between the timing gears must be retained to ensure precise timing of the opening and closing of the valves. If there is any error in the relative angle between the timing gears, the power of the engine will be jeopardized. If the error is minor, it can be corrected. If the error is serious, it could damage the engine and/or other elements related to the transmission of power.

Conventionally, a mark is made on the old timing belt and the relative angle between the timing gears is memorized before the old timing belt is removed from the timing gears. Later, the new timing belt is wound around the timing gears. Human memory is however not reliable, and the correct relative angle between the timing gears is not ensured. Hence, the new timing belt around the timing gears is always driven manually for several rounds before the engine is started, and this is an inconvenient practice.

The relative angle between the timing gears can be held with a holding device disclosed in U.S. Pat. No. 6,332,256. The holding device includes holding members 10, 11, 12 and 13 and connecting means 14. The connecting means 14 includes a connecting member 25 formed with two ends each pivotally connected to a relative one of the holding members 10 and 12. The holding members 11 and 13 are pivotally connected to the holding members 10 and 12, respectively. The holding member 10 includes a protuberance 19 that can be located between two adjacent ones of the teeth of a first timing gear. The holding member 11 includes a protuberance 20 that can be located between two other adjacent ones of the teeth of the first timing gear. The holding member 12 includes a protuberance 19 that can be located between two adjacent ones of the teeth of a second timing gear. The holding member 13 includes a protuberance 20 that can be located between two other adjacent ones of the teeth of the second timing gear.

Each of the holding members 10 and 12 includes a slot 21. A clamping screw is driven in each of the holding members 11 and 13 through the slot 21 defined in a related one of the holding members 10 and 12. Therefore, the relative position between the protuberances 19 and 20 is adjustable and the holding device can be used to hold the timing gears of various vehicles. It is however difficult to use the clamping screws to hold the relative position between the protuberances 19 and 20 since the clamping screws tend to slid along the slots 21.

The present invention is therefore intended to obviate or at least alleviate the problems encountered in prior art.

SUMMARY OF INVENTION

It is the primary objective of the present invention to provide a reliable device for holding a relative angle between timing gears.

To achieve the foregoing objective, the device includes a connector, two stationary engagement elements, two levers, two movable engagement elements and two fastening units. Each of the stationary engagement elements extends from the connector and can be located between two adjacent teeth of a related one of the timing gears. The levers are pivotally connected to the connector. Each of the movable engagement elements is movably connected to a related one of the levers and can be located between two other adjacent teeth of a related one of the timing gears. Each of the fastening units is operable to retain a related one of the movable engagement units in position relative to a related one of the levers.

Other objectives, advantages and features of the present invention will become apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
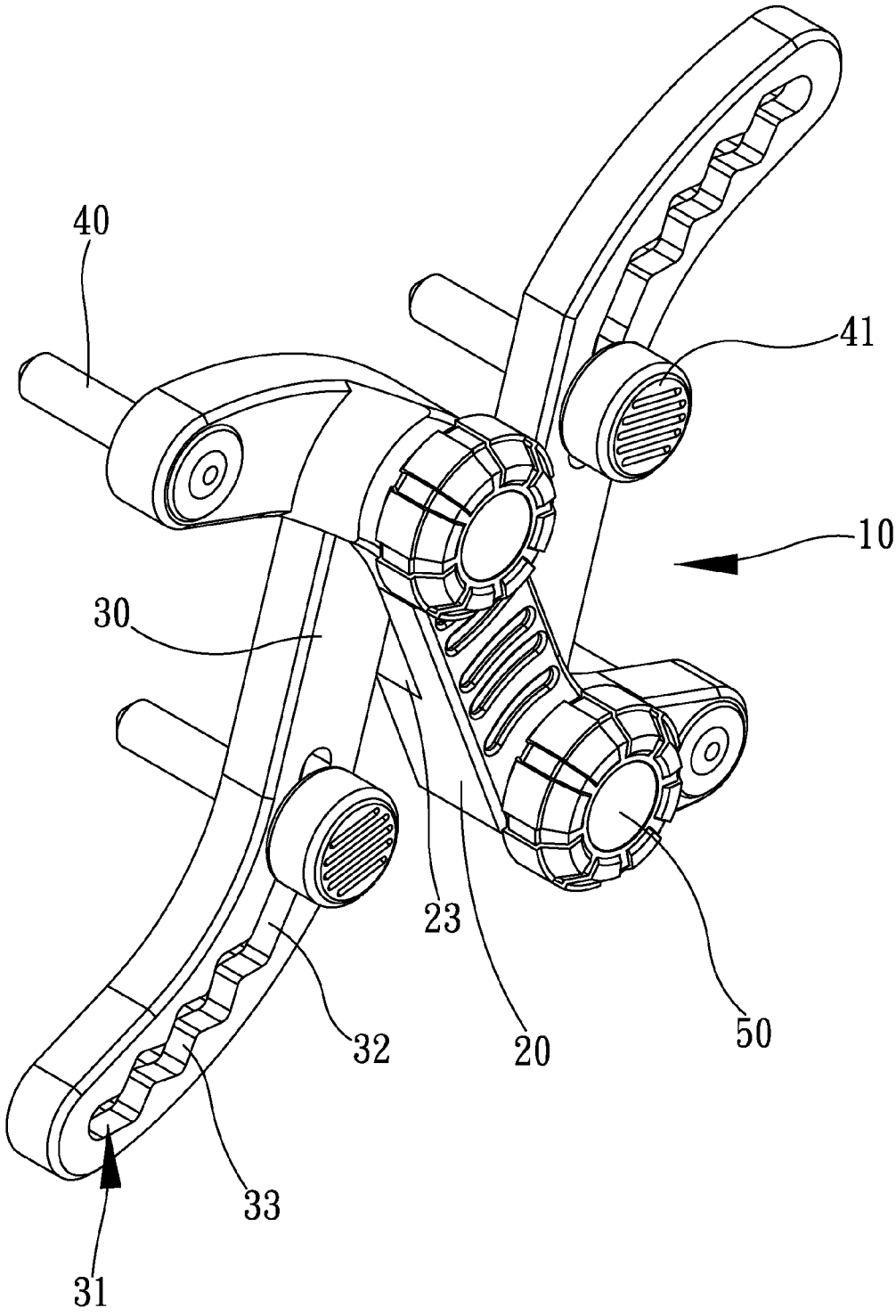
FIG. 1 is a perspective view of a device for holding timing gears according to the preferred embodiment of the present invention.
Figure 2:
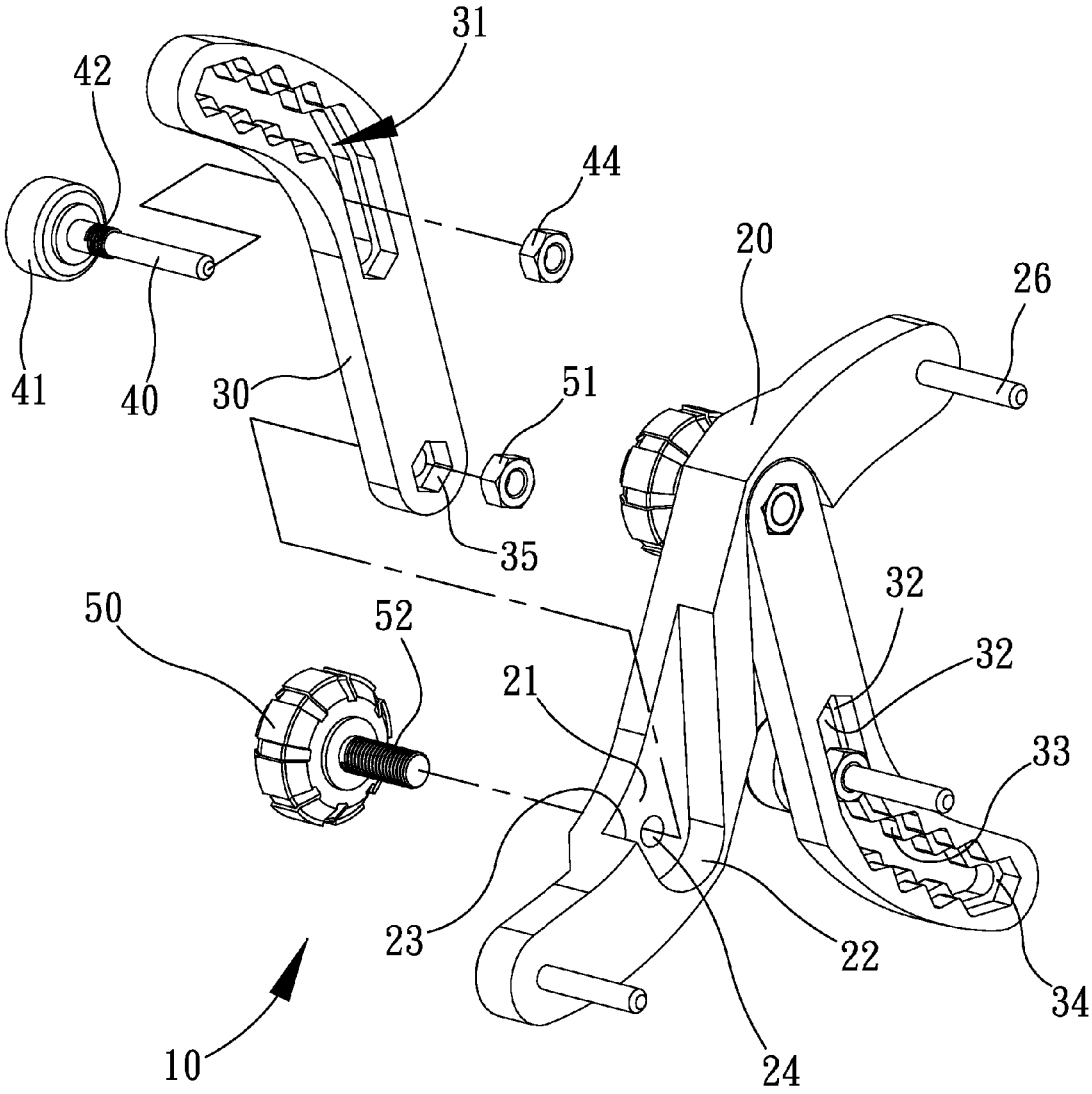
FIG. 2 is an exploded view of the device shown in FIG. 1.
Figure 3:
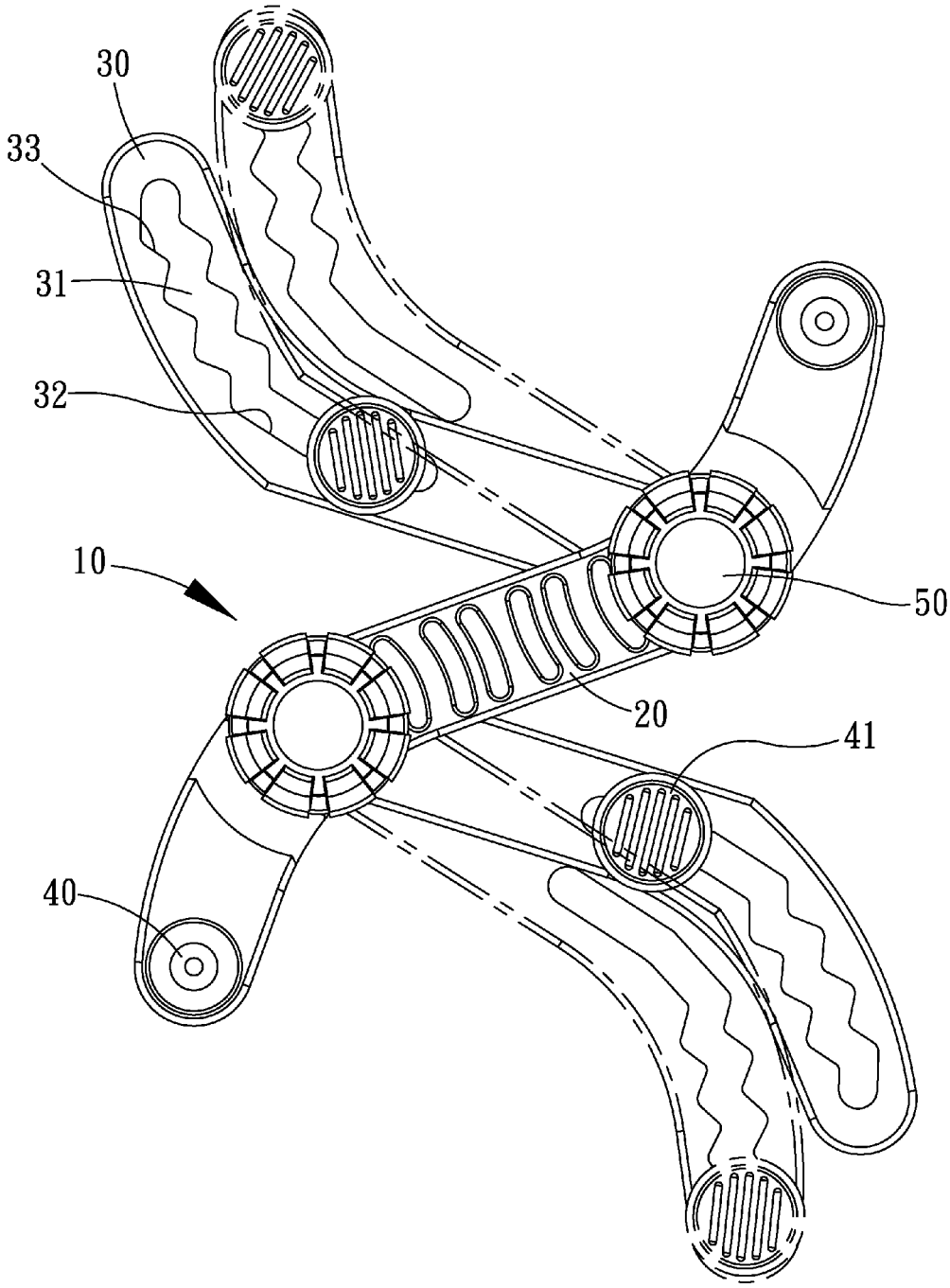
FIG. 3 is a top view of the device shown in FIG. 1.

Referring to FIGS. 1 through 4, two timing gears 60 are held with a device 10 according to the preferred embodiment of the present invention. The device 10 includes a connector 20, two stationary engagement elements 26, two levers 30, two movable engagement elements 40 and two fastening units.

The connector 20 includes two cavities 21 defined therein. Each of the cavities 21 includes a floor, a wall 22 on the floor, and an opening 23 opposite to a substantially middle portion of the wall 22. An aperture 24 is defined in the floor of each of the cavities 21.

Each of the stationary engagement elements 26 is in the form of a rod extending from the connector 20. However, each of the stationary engagement elements 26 can be a rod that is made separately and then connected to the connector 20 according to another embodiment.

Each of the levers 30 includes a slot 31 defined in a first section and a countersink hole 35 defined in a second section. The slot 31 includes a smooth section 32 and a zigzag section 33 along the length. The slot 31 includes a wide section and a narrow section along the depth. That is, the slot 31 looks like a countersink hole. Thus, two shoulders 36 are formed within the smooth section 32 and two shoulders 34 are formed within the zigzag section 33. Each of the countersink holes 35 includes a hexagonal section and a smaller circular section along the depth.

Each of the movable engagement elements 40 is in the form of a rod formed with a thread 42. A knob 41 is secured to an end of each of the movable engagement elements 40.

Each of the fastening units includes a screw 52 and a nut 51. A knob 50 is secured to an end of the screw 52.

In assembly, the second section of each of the levers 30 is located in a related one of the cavities 21. The pivotal of the second sections of the levers 30 within the cavities 21 are limited by the walls 22. Each of the screws 52 is inserted through a related one of the apertures 24 and the countersink hole 35 of a related one of the levers 30. By operating the knob 50 of each of the fastening units, the screw 52 is engaged with the nut 51. Thus, the levers 30 are connected to the connector 20. The nuts 51 are located within the countersink holes 35 non-rotationally to facilitate the rotation of the screws 52 relative to the nuts 51.

Each of the movable engagement elements 40 is inserted through the smooth section 32 or the zigzag section 33 of the slot 31 of a related one of the levers 30. By operating each of the knobs 41, the thread 42 of a related one of the movable engagement elements 40 is engaged with the thread of a related one of the nuts 44. Each of the knobs 41 is abutted against a side of a related one of the levers 30 and the related nut 44 is abutted against the shoulders 36 or 34. Thus, the movable engagement elements 40 are connected to the levers 30. The nuts 44 are located within the slots 31 non-rotationally to facilitate the rotation of the threads 42 with the threads of the nuts 44. The nuts 44 can be firmly held in the zigzag sections 33 of the slots 31.

Figure 4:
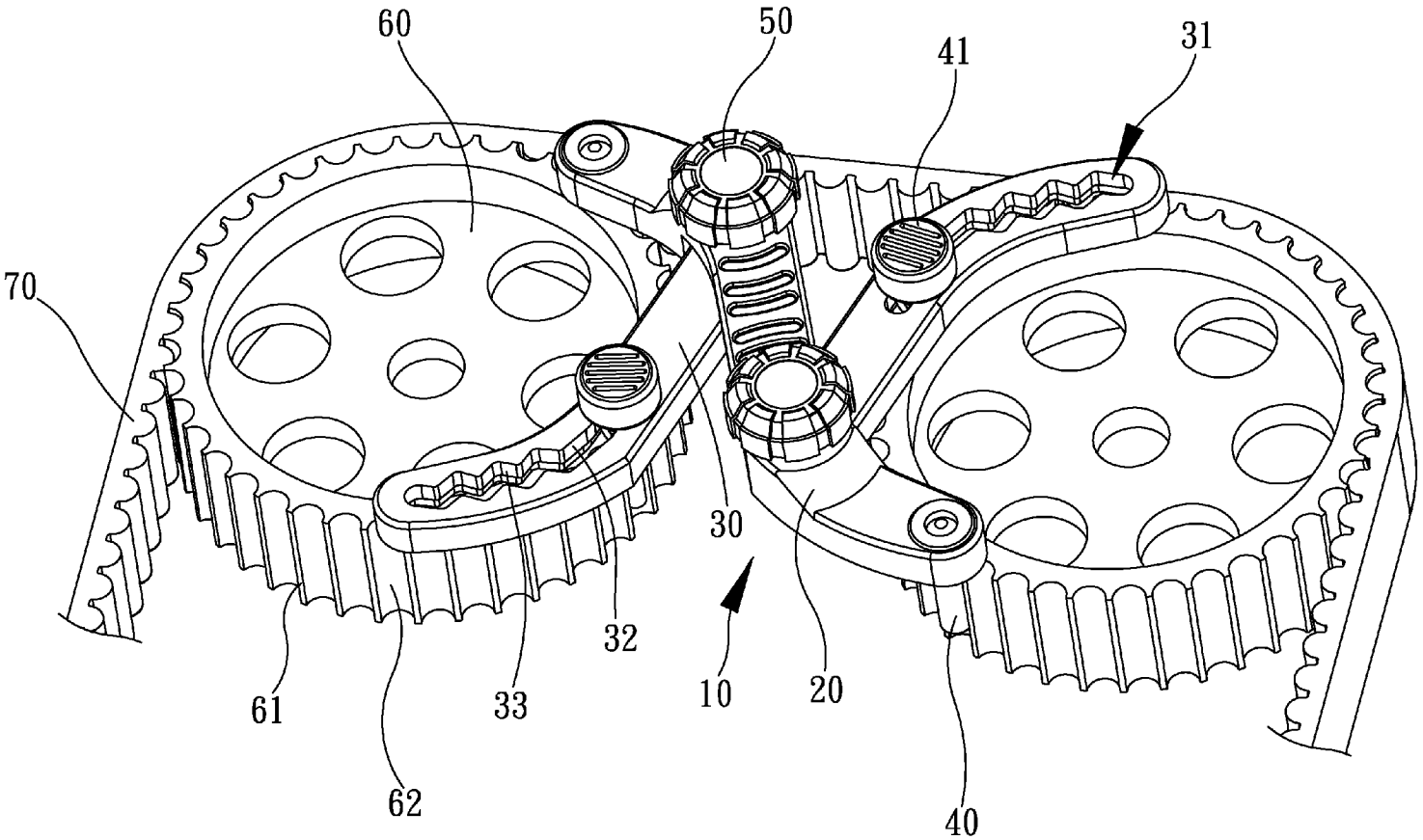
FIG. 4 is a perspective view of two timing gears held with the device shown in FIG. 1.

Referring to FIG. 4, there are shown two timing gears 60 engaged with a timing belt 70. Each of the timing gears 60 includes teeth 61 formed thereon and recesses 62 each defined between any adjacent ones of the teeth 61. The teeth 61 of the timing gears 60 can be engaged with teeth formed on a side of the timing belt 70.

In operation of the device 10, each of the stationary engagement elements 26 is located in one of the recesses 62 of a related one of the timing gears 60 while each of the movable engagement elements 40 is located in another one of the recesses 62 of a related one of the timing gears 60. By operating the knobs 41, the threads 42 are firmly engaged with the threads of the nuts 44, and the positions of the movable engagement elements 40 relative to the levers 30 are retained. By operating the knobs 50, the screws 52 are firmly engaged with the nuts 51, and the positions of the levers 30 relative to the connector 20 are retained. Therefore, the positions of the engagement elements 26 and 40 relative to one another are retained, and a relative angle between the timing gears 60 is retained. Now, the timing belt 70 can be removed from the timing gears 60.

To hold a relative angle between timing gears of various sizes, the knobs 41 are operated to change the positions of the movable engagement elements 40 relative to the levers 30. The knobs 50 are operated to change the positions of the levers 30 relative to the connector 20. Hence, the positions of the engagement elements 26 and 40 relative to one another are adjustable corresponding to timing gears of various sizes.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A device for holding a relative angle between two timing gears, the device comprising:

a connector including two cavities each defined by a wall;

two stationary engagement elements connected to the connector, wherein each of the stationary engagement elements can be located between two adjacent teeth of a relative one of the timing gears;

two levers each including a section pivotally located in a related one of the cavities so that the pivoting of the lever is limited by the wall;

two movable engagement elements each movably connected to a related one of the levers, wherein each of the movable engagement elements can be located between two other adjacent teeth of a related one of the timing gears; and two fastening units each operable to retain a related one of the movable engagement elements in position relative to a related one of the levers.

2. The device according to claim 1, wherein the each of the cavities includes an opening opposite to a substantially middle portion of the wall.

3. The device according to claim 1, wherein each of the levers includes a slot defined therein, wherein each of the movable engagement elements is inserted through and movable along the slot of a related one of the levers.

4. The device according to claim 3, wherein the slot includes a smooth section and a zigzag section along the length.

5. The device according to claim 4, wherein the smooth section of the slot includes two shoulders abutted against a nut engaged with a thread of each of the movable engagement elements.

6. The device according to claim 4, wherein the zigzag section of the slot includes two shoulders abutted against a nut engaged with a thread of each of the movable engagement elements.

7. A device for holding a relative angle between two timing gears, the device including:

a connector;

two stationary engagement elements each of which is attached to the connector and can be placed between two teeth of a relative one of the timing gears;

two levers each including a slot including a smooth section and a zigzag section along the length;

two movable engagement elements each of which is movably inserted in the slot of a related one of the levers and can be located between two other teeth of a related one of the timing gears; and two fastening units each operable to retain a related one of the movable engagement elements in position relative to the related lever.

8. The device according to claim 7, wherein the smooth section of the slot includes two shoulders abutted against a nut engaged with a thread of each of the movable engagement elements.

9. The device according to claim 7, wherein the zigzag section of the slot includes two shoulders abutted against a nut engaged with a thread of each of the movable engagement elements.

* * * * *